US006169848B1

(12) United States Patent
Henry

(10) Patent No.: US 6,169,848 B1
(45) Date of Patent: Jan. 2, 2001

(54) CROSS-DIRECTION DRYER FOR A MACHINE PRODUCING SHEET MATERIAL MOVING IN A MACHINE DIRECTION HAVING BOTH GAS POWERED AND ELECTRIC HEATING PORTIONS

(75) Inventor: Lee L. Henry, San Jose, CA (US)

(73) Assignee: Impact Systems, Inc., Los Gatos, CA (US)

( * ) Notice: Under 35 U.S.C. 154(b), the term of this patent shall be extended for 0 days.

(21) Appl. No.: 09/479,308

(22) Filed: Jan. 6, 2000

(51) Int. Cl.[7] ..... F24C 1/00

(52) U.S. Cl. ..... 392/307; 392/417; 219/388; 34/274; 34/419; 34/68

(58) Field of Search ..... 34/273, 274, 418–422, 34/426, 427, 68, 62, 543, 545, 553, 90, 618, 624; 219/388; 392/307, 417

(56) References Cited

U.S. PATENT DOCUMENTS

| | | | | |
|---|---|---|---|---|
| 2,565,570 | * | 8/1951 | Messinger | 219/19 |
| 3,040,807 | * | 6/1962 | Chope | 162/252 |
| 3,499,232 | * | 3/1970 | Zimmermann | 34/68 |
| 3,864,546 | * | 2/1975 | Cahnman et al. | 219/354 |
| 3,950,650 | * | 4/1976 | Pray et al. | 250/504 |
| 3,997,317 | * | 12/1976 | Dicks | 65/350 |
| 4,015,340 | * | 4/1977 | Treleven | 34/4 |
| 4,188,731 | * | 2/1980 | Rauskolb | 34/41 |
| 4,202,112 | * | 5/1980 | von der Eltz et al. | 34/4 |
| 4,297,583 | * | 10/1981 | Nerod | 250/453 |
| 4,494,316 | | 1/1985 | Stephansen et al. | 34/68 |
| 4,655,812 | * | 4/1987 | Blumenfeld | 65/346 |
| 4,908,956 | | 3/1990 | Grund | 34/48 |
| 5,319,861 | * | 6/1994 | Tate | 34/273 |
| 5,440,821 | * | 8/1995 | Hamrin | 34/420 |
| 5,553,391 | * | 9/1996 | Bakalar | 34/273 |
| 5,827,270 | * | 1/1999 | Bria | 34/329 |
| 5,867,920 | * | 2/1999 | Rogne et al. | 34/267 |
| 6,049,995 | * | 4/2000 | Rogne et al. | 34/269 |
| 6,067,726 | * | 5/2000 | Rogne et al. | 34/421 |

* cited by examiner

*Primary Examiner*—Denise L. Ferensic
*Assistant Examiner*—Andrea M. Joyce
(74) *Attorney, Agent, or Firm*—Jerry G. Wright; Flehr Hohbach Test Albritton & Herbert LLP

(57) ABSTRACT

A cross-direction dryer for typically drying a continuous web of paper or paper to which coating has just been applied provides both for baseline drying and a linear moisture profile by the use of respectively gas and electric heating portions of the heater units. Profile control is normally provided by control of the voltage to electric heating lamps. Such heating lamps are suspended over a large area gas burner to provide a combined increased infrared heat output. Encapsulation of the heating lamps with quartz provides for reradiation of the medium wavelength radiation produced by the gas burner. Thyristor switching for the quartz halogen heat lamps may be located adjacent to each heater unit and cooled by the combustion air for the gas burners.

5 Claims, 4 Drawing Sheets

CROSS-DIRECTION DRYER FOR A MACHINE PRODUCING SHEET MATERIAL MOVING IN A MACHINE DIRECTION HAVING BOTH GAS POWERED AND ELECTRIC HEATING PORTIONS

INTRODUCTION

The present invention is directed to a cross-direction dryer for a machine producing sheet material moving in a machine direction having both gas powered and electric heating portions and more specifically, to a heater for drying moving sheet material such as paper either where uniform moisture content is desired or a recently applied coating to the paper must be dried.

BACKGROUND

Description of Prior Art

Radiant heaters having quartz infrared lamps with tungsten filaments located in the cross-direction of a moving web of paper and which may be individually controlled to provide an even moisture profile are disclosed in U.S. Pat. No. 4,908,956. Here the specific technique of power control of the heat lamps is shown.

For drying paper in general for what is termed called baseline drying gas fired infrared burners have been used. In general, such gas infrared drying systems have not been capable of profile control (that is of providing differential heat from one zone or slice of the paper being produced to another).

Thus it is desired to increase the total infrared density or drying capacity of systems such as above while still maintaining the ability to do all of the foregoing in a compact and efficient manner.

OBJECT AND SUMMARY OF INVENTION

It is therefore a general object of the present invention to provide an improved cross-direction dryer for a machine producing sheet material moving in a machine direction having both gas powered and electric heating portions.

In accordance with the above object there is provide a cross-direction dryer for a machine producing sheet material moving in a machine direction perpendicular to the cross-direction, the sheet material having a moisture content and/or a recently applied coating comprising a plurality of heater units arranged side-by-side supported on a common frame spanning the width of the sheet in the cross-direction, each heater unit having both electric and gas powered heating portions.

The gas powered portions each include a large area burner.

The electric portions each include a plurality of high impedance wires suspended over the burner, Power supply means supply controllable voltages to the wires to provide different heat outputs for each heater unit.

DESCRIPTION OF PREFERRED EMBODIMENTS

Figure 1:
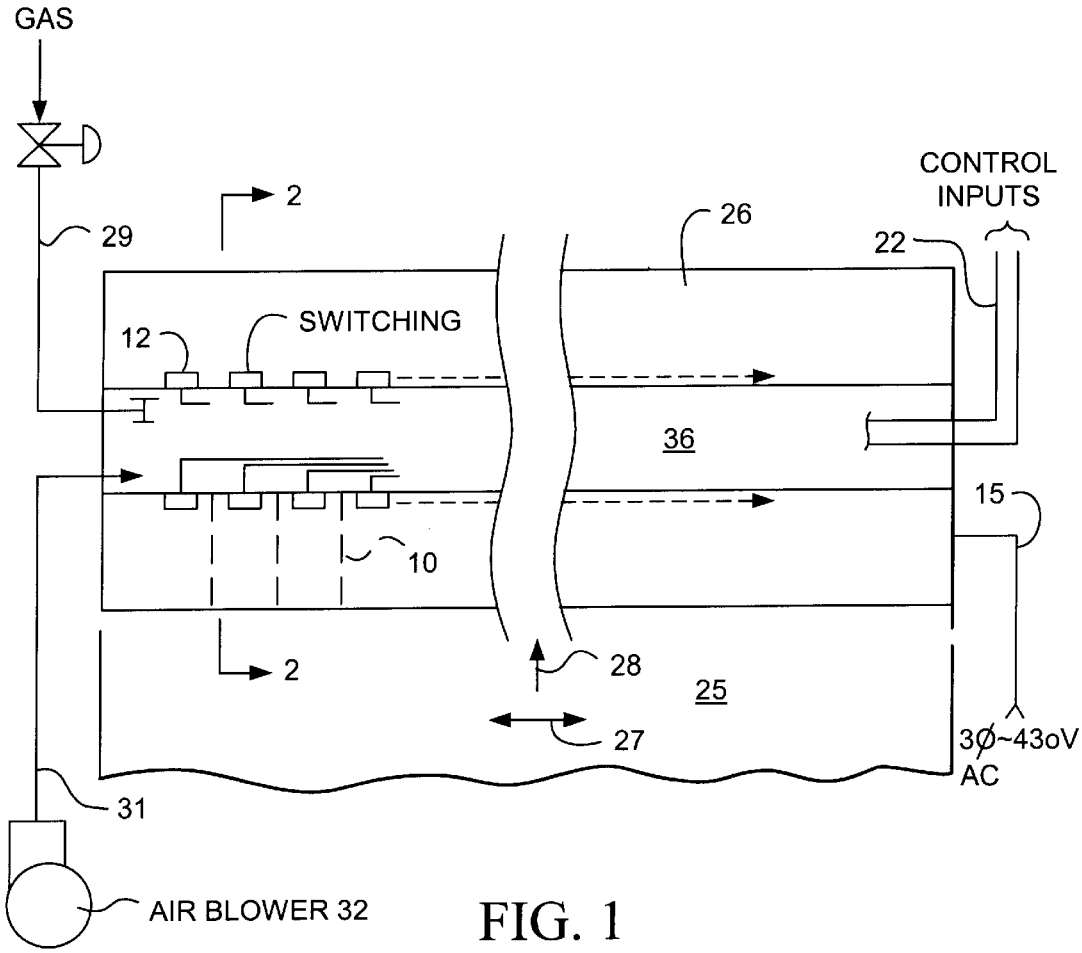
FIG. 1 is a simplified cross-sectional view of a frame carrying the present invention which spans the width of a paper web in the cross direction.

FIG. 1 illustrates a moving web of sheet material 25, such as paper which is being manufactured by a standard paper making machine after being formed through appropriate pressure rollers. It is dried by a plurality of side-by-side combined electric/gas heater units 10 indicated by the dashed lines which are carried by a frame 26. Heater frame 36 spans the width of the sheet 25 in its cross-direction 27. The moving sheet of course has a machine direction 28. Each heater unit 10, may correspond to a zone of for example six inches, also known as a slice, of the paper being manufactured.

For profile drying purposes the heater unit itself may be divided into smaller, controllable portions. To supply the heater units 10, frame 26 has a gas input 29, a combustion air input 31 including an air blower 32, a 3-phase AC-input 15, which may be for example 430 volts AC, and finally computer control inputs 22. The control inputs 22 each individually control thyristor switching units 12, a pair of which are associated with each heater unit 10.

Figure 2:
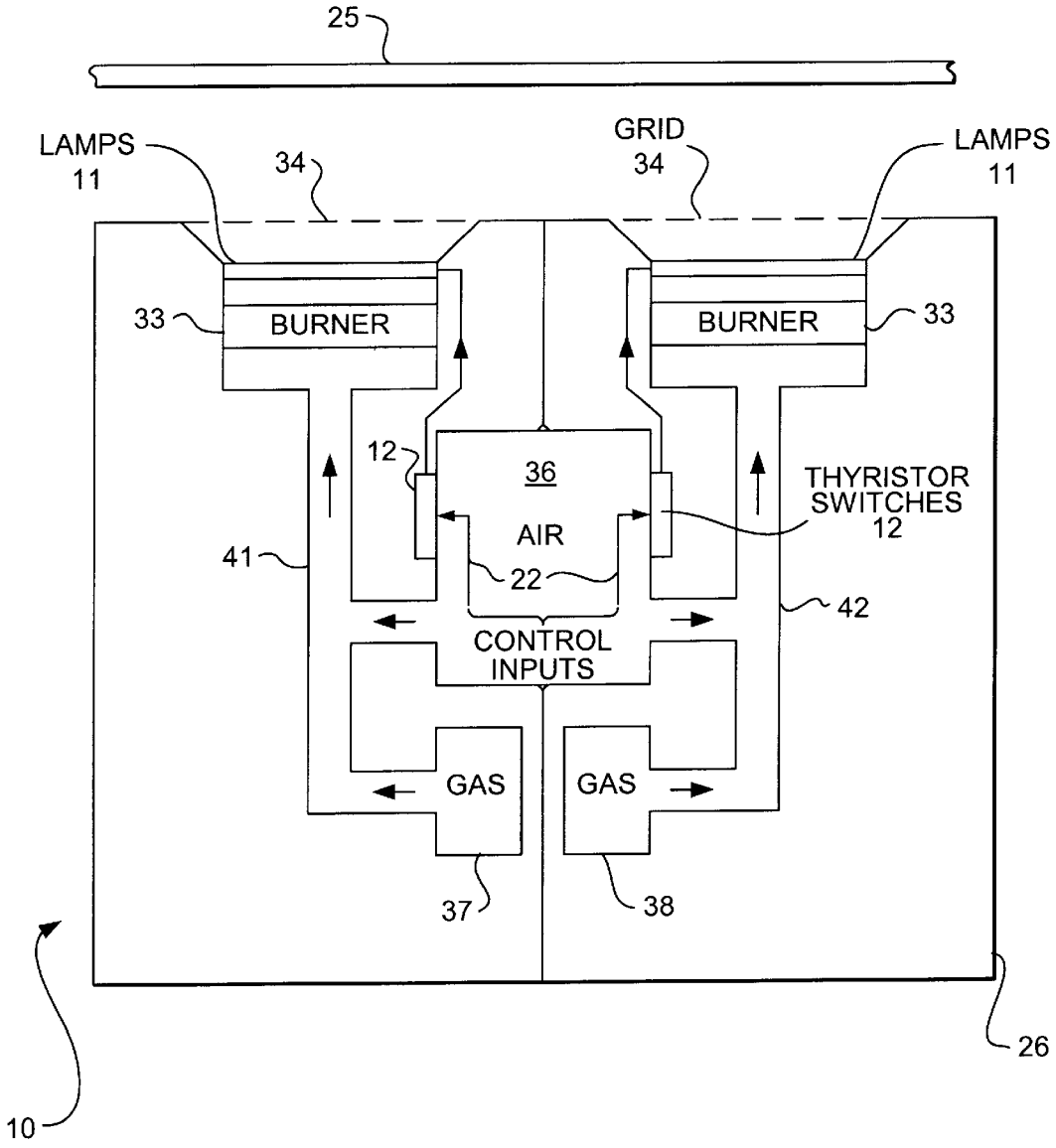
FIG. 2 is a simplified cross-sectional view substantially taken along the line 2—2 of FIG. 1.

An individual heater unit 10, as shown in greater detail in FIG. 2, includes quartz heat lamps 11, having a tungsten filament which are suspended over the gas burners 33. Metal grids 34 cover the lamps 11 and burner 33 to protect the moving paper 25. The grid may be nichrome wire arranged in a screen-type mesh (or quartz glass). Carried by the frame 26 is an air manifold 36 which, also referring to FIG. 1, receives air from air blower 32 and the air input 31. Frame 26 also carries gas pipes 37 and 38. Both gas and combustion air are intermixed in the common supply pipes 41 and 42 to supply the burners 33.

Thyristor switches 12 have their heat sinks arranged at the surface of the air manifold 36 so that the combustion air provides cooling for these switches. Finally, the control inputs 22, drive the thyristor switches 12 as shown.

From an operational point of view the quartz lamps 11 juxtaposed over or suspended over the burners 13 increase the infrared density output of the drying unit. This will be explained below. The lamps 11 are voltage controllable for profile control. The burners 33 provide for baseline drying (that is they dry the entire width of the web). Such drying controls the moisture content of the paper itself, or a coating which has been applied, to a suitable baseline.

The lamps 11 may merely be high impedance wire. But in this embodiment they are quartz lamps (that is a quartz glass tube encapsulating a tungsten filament). The quartz is inherently capable of absorbing the medium wavelength radiation produced by the gas burners 33. The burners operate at a 1,500 to 2,000° F. to produce such medium wavelength radiation. In contrast, the halogen lamps 11 of tungsten and quartz operate at a higher temperature and thus have a shorter wavelength infrared radiation. From a drying standpoint the medium wavelength radiation provides for a shallow drying effect and the shorter wavelengths provide for deeper drying. Thus the combination in one efficient structure of gas and electric portions provides for increased infrared drying density and capability.

Figure 3:
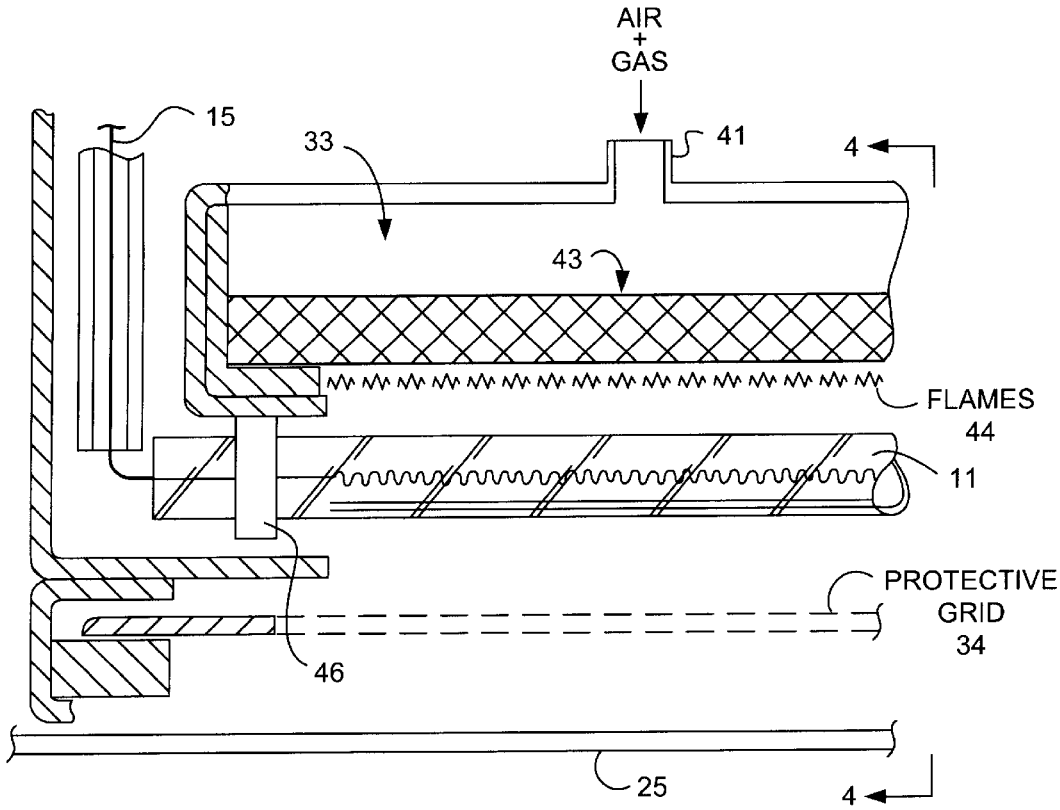
FIG. 3 is an enlarged, detailed cross-sectional view of a portion of FIG. 2.
Figure 4:
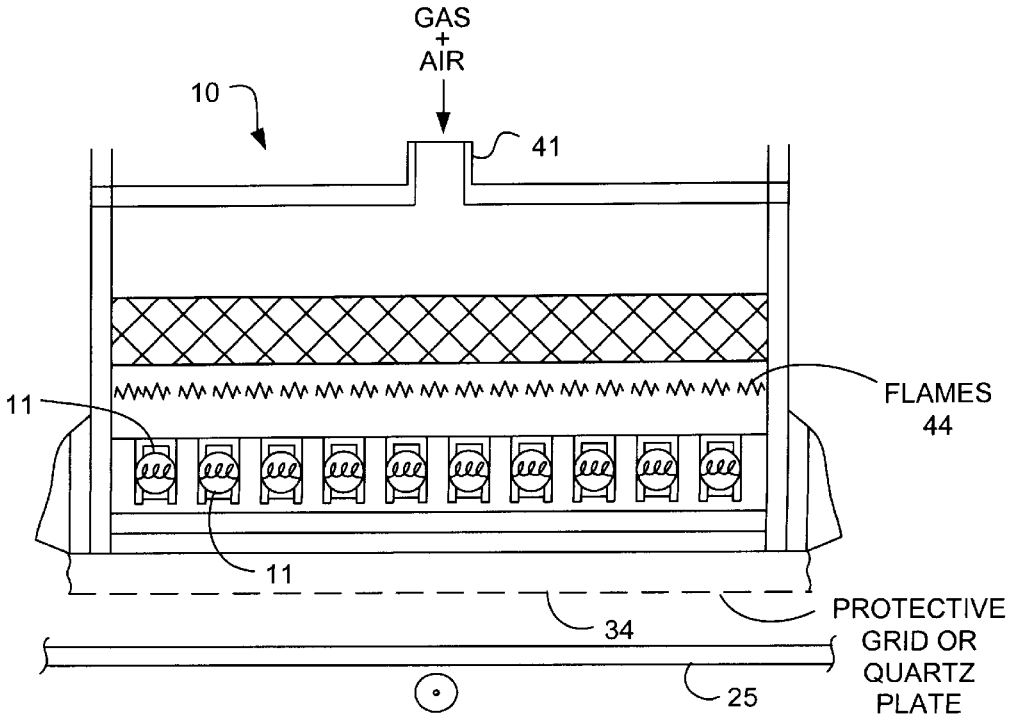
FIG. 4 is end view of FIG. 3, taken substantially along the lines 4—4.

Both FIGS. 3 and 4 illustrate a typical burner 33 and heat lamps 11. Burner 33 includes a metal fiber mesh mat 43 which the air and gas supplied by pipe 41 passes through and is ignited to produce flames indicated at 44. Then a quartz halogen lamp 11 is suspended by a pair of clips 46 (only one is shown). The 3-phase electrical power is indicated at 15.

FIG. 4 is an end view of an entire heater unit 10 which shows a plurality of side-by-side lamps 11 which may be arranged either parallel to each other in the machine direction or in a cross-direction or in the form of an electrical heating grid, if desired. The protective grid 34 can be a wire mesh type screen or quartz plates.

Figure 5:
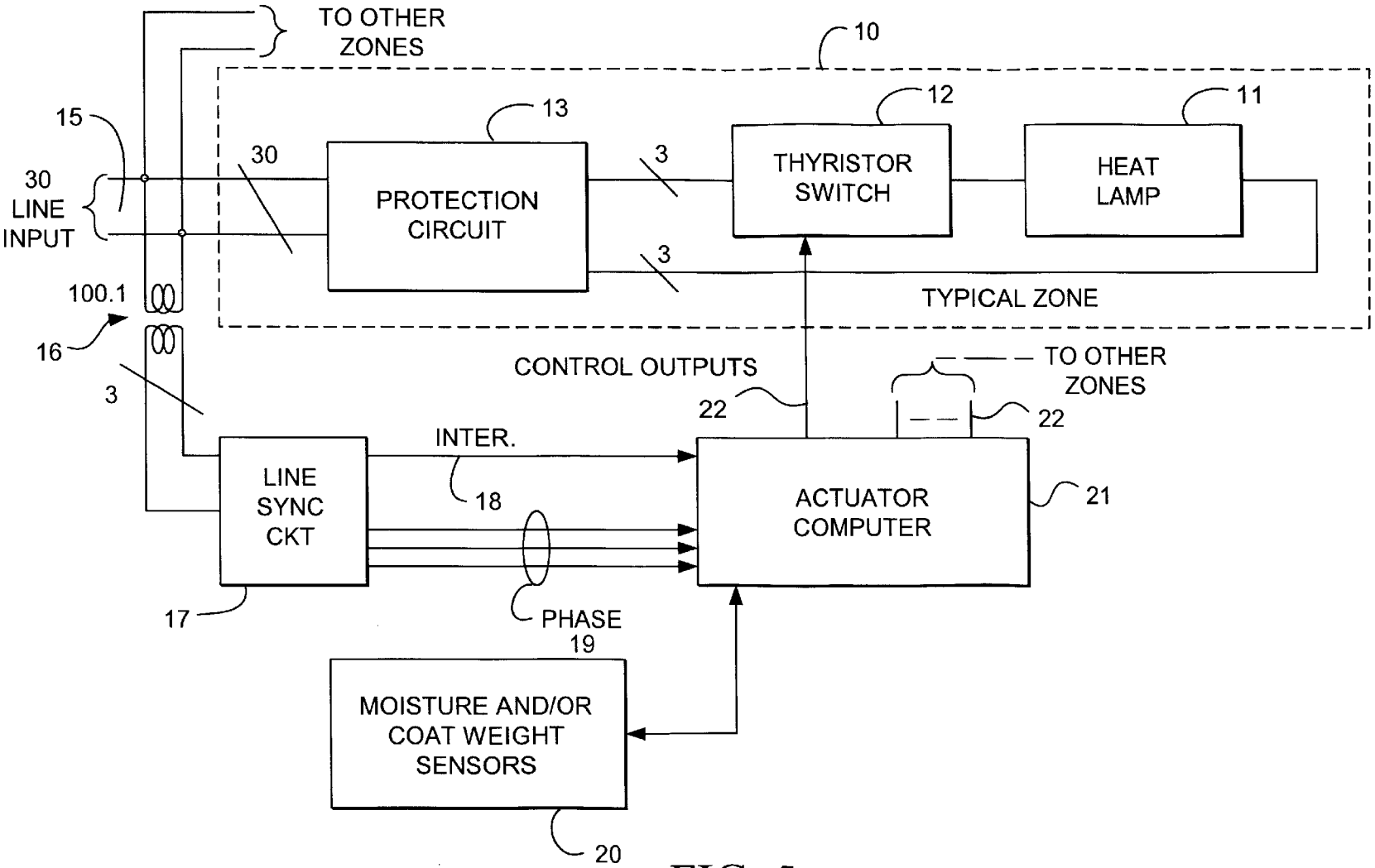
FIG. 5 is a partial electrical diagram showing an electric portion of the invention.

FIG. 5 illustrates the controller for the quartz halogen lamps 11. For a typical zone having a single heater unit 10 it includes the thyristor switch 12 located in proximity to the heat lamps and cooled by the combustion air, along with a protection circuit 13 which is driven by the 3-phase line input 15. This 3-phase line extends to other zones which may number as many as 150.

In a central control location for all of the zones, information as to 3-phase input 15 is tapped off via the instrumentation transformer 16, and the 3-phrase input is fed into a line sync circuit 17. This circuit provides an interrupt output 18 at every zero-crossing of the 3-phrase waveforms as discussed in the '956 patent. Phase and information is transferred via line 19 to actuator computer 21. This computer by means of its control lines 22 drives the thyristor switches in each zone and provides the different power levels for differential drying. Feedback control from a moisture and/or coat weight sensor 20 is provided. These sensors are commercially available.

Figure 6:
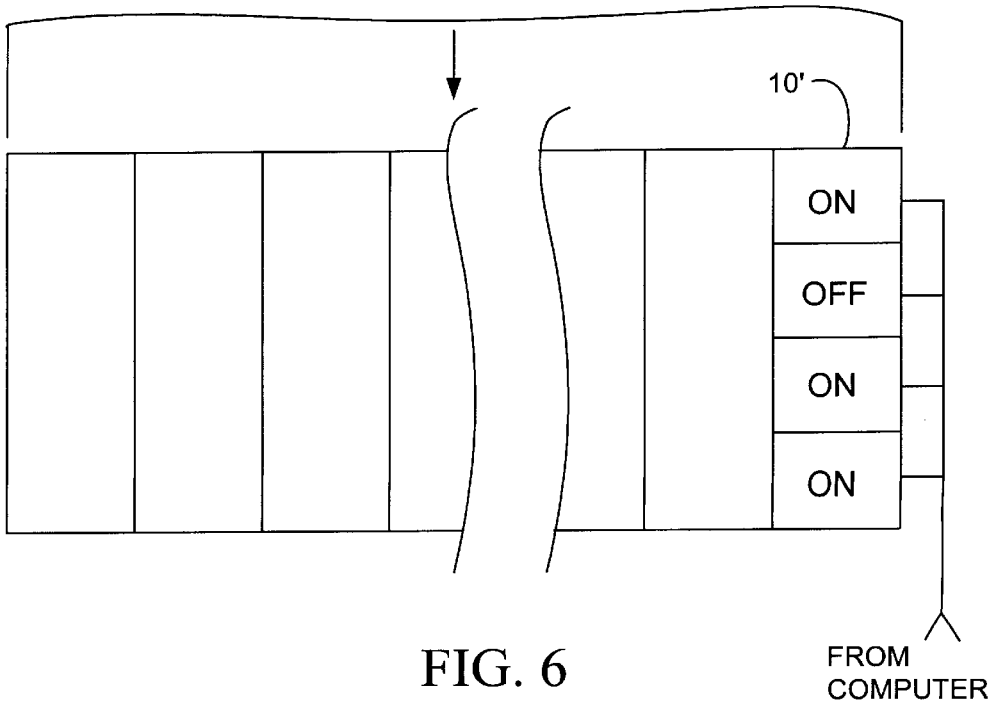
FIG. 6 is a simplified plan view of the an alternative embodiment of a burner portion of the invention.

As thus far described, profile or zone-type drying is possible only with the quartz halogen lamps 11. However, referring to FIG. 6 a heater unit 10 may be modified so that the gas burners are separated into, for example, four different zones and the computer actuator 21 may by appropriate valves determine which portion of the gas heater is on or off to provide a differential heat output from zone to zone.

Thus an improved cross direction dryer for a machine producing material has been provided.

What is claimed is:

1. A cross-direction dryer for a machine producing sheet material moving in a machine direction perpendicular to the cross-direction, the sheet material having a moisture content and/or a recently applied coating comprising:

a plurality of heater units arranged side-by-side supported on a common frame spanning the width of said sheet in said cross-direction, each heater unit having both electric and gas powered heating portions, said gas powered portions each including a large area burner, said electric portions each including a plurality of high impedance wires suspended over said burner, and power supply means for supplying controllable voltages to said wires to provide different heat outputs for each said heater unit.

2. A cross-direction dryer as in claim 1 where said electric heating portions include quartz tubes encapsulating said wires said quartz having the capability of absorbing medium wavelength radiation produced by said gas powered portions burning at approximately 1500 to 2000° F. and reradiating even while no voltage is applied to said wires.

3. A cross-direction dryer as in claim 1 where said gas heating portions include a cross-direction manifold carried by said frame for supplying combustion air to all of said heater units, and said electric heating portions each including a solid state switching module for driving each unit physically located at each unit, said modules being located in proximity to said air manifold to take advantage of the cooling effect of said combustion air.

4. A cross-direction dryer as in claim 1 where said large area burner is a mat of metal fiber mesh.

5. A cross-direction dryer as in claim 1 where said gas powered portions burn at approximately 1500 to 2000° F. to produce a medium wave length radiation which provides shallow drying and said electric portions operate in a temperature range to provide short wavelength radiation which provides deeper drying.

* * * * *